United States Patent [19]

Leslie

[11] Patent Number: 4,986,540

[45] Date of Patent: Jan. 22, 1991

[54] ERRATICALLY MOVABLE INFLATED GAME BALL

[76] Inventor: William O. Leslie, P.O. Box 88, Troutlake, Wash. 98650

[21] Appl. No.: 514,300

[22] Filed: Apr. 20, 1990

[51] Int. Cl.[5] ..... A63B 43/04; A63B 41/00; A63B 45/00

[52] U.S. Cl. ..... 273/58 H; 446/221; 446/437; 446/267; 273/65 ED; 273/428; 273/65 D

[58] Field of Search ..... 273/58 R, 58 B, 58 BA, 273/58 C, 58 E, 58 F, 58 G, 58 H, 58 J, 58 K, 428; 446/221, 437, 267

[56] References Cited

U.S. PATENT DOCUMENTS

| | | | |
|---|---|---|---|
| 1,513,773 | 11/1924 | Thompson | 273/58 F |
| 2,351,762 | 6/1944 | Hoover | 273/58 F |
| 3,163,421 | 12/1964 | Matyko | 273/58 F |
| 3,498,613 | 3/1970 | Dreyer | 273/58 F |
| 3,655,197 | 4/1972 | Milbaum | 273/58 H |
| 4,194,737 | 3/1980 | Farmer | 273/58 BA |
| 4,213,267 | 7/1980 | Curtis | 446/221 |
| 4,300,767 | 11/1981 | Reed et al. | 273/61 R |
| 4,448,418 | 5/1984 | McNeill | 273/58 F |
| 4,842,563 | 6/1989 | Russell | 273/58 F |
| 4,915,669 | 4/1990 | Russell | 273/58 BA |

FOREIGN PATENT DOCUMENTS

| | | | |
|---|---|---|---|
| 846327 | 6/1939 | France | 273/58 F |
| 261614 | 11/1926 | United Kingdom | 273/58 H |

*Primary Examiner*—George J. Marlo
*Attorney, Agent, or Firm*—Klarquist, Sparkman, Campbell, Leigh & Whinston

[57] ABSTRACT

The game device includes a hollow outer ball and a small relatively heavy mass inside the ball. The mass is a flexible bladder which contains a liquid. When the ball is rolled or projected, the bladder moves around inside and changes shape so that the device travels erratically. In a preferred process of making the game device, all but a filler passageway portion of the flexible bladder is inserted into an outer ball through an inflation opening in the outer ball. Then, in sequence, the liquid is injected into the bladder through its filler passageway, the passageway is sealed, the bladder is fully inserted into the ball, the outer ball is inflated to a desired pressure, and the inflation opening in the outer ball is sealed.

4 Claims, 2 Drawing Sheets

ERRATICALLY MOVABLE INFLATED GAME BALL

BACKGROUND OF THE INVENTION

The present invention concerns game balls and more specifically balls that are intended to roll or travel through the air in an erratic path.

A number of balls have been designed to behave erratically. For example, U.S. Pat. No. 3,498,613 (Dreyer) shows a tethered ball which contains an inner, smaller ball to induce erratic movement.

Similarly, U.S. Pat. No. 4,194,737 (Farmer) shows a variety of ball designs wherein a hollow body encloses a spherical weight. Additionally, magnets are used to cause the body and weight to interact less predictably.

The need for such an interaction between the inner and outer balls can be understood with reference to French Patent No. 846,327 (Ratignier) which seems to indicate that a hollow outer ball with a spherical inner ball is actually highly stable, rather than erratic, particularly when used on rough surfaces This is apparently due to the low center of gravity of the entire ball.

Others have included objects inside of balls, but for other purposes. Such balls are shown Hoover in U.S. Pat. Nos. 2,351,762; Milbaum 3,655,197and Reed et al. 4,300,767.

SUMMARY OF THE INVENTION

The present invention is a ball which achieves highly erratic motion without mechanical complexities of prior art devices such as those shown in the Farmer patent.

According to the present invention, an outer hollow ball contains relatively small inner mass. The mass comprises a flexible bladder which contains a liquid.

When the ball is rolled, thrown, or kicked, the bladder moves around inside the ball and changes shape as it moves. The movement and changing shape of the bladder causes the device to move erratically.

DETAILED DESCRIPTION

Figure 1:
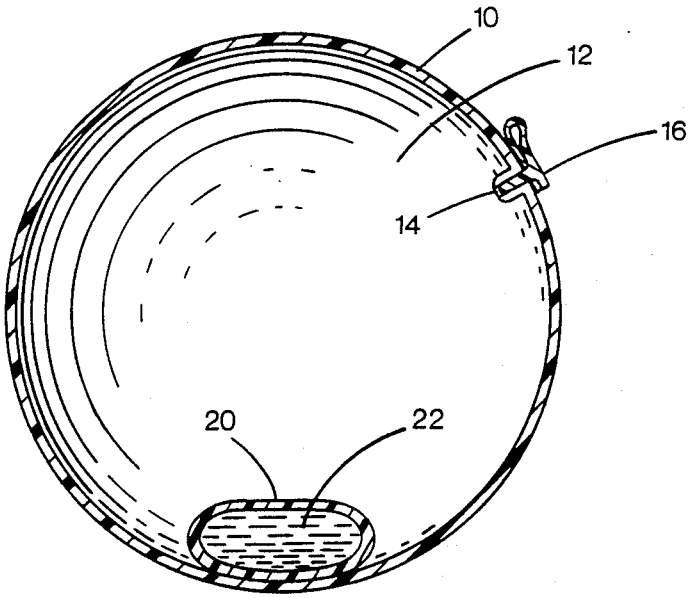
FIG. 1 is a cross-sectional view of a ball according to the present invention.

A preferred embodiment of the game device of the present invention includes a hollow ball 10 made of an elastomeric material and inflated with air 12. Most preferably the ball is made of a thin, flexible sheet material that is impermeable to air and other inflation gasses. Although not essential, it is preferred that there be a sealable opening 14 in the outer ball 10 for the purpose of inflation and deflation and to service the contents of the ball. The illustrated ball is inflated via a filler opening 14 which may be sealed by a hinged cap 16. Balls commonly referred to as "beach balls" are well suited for use as the outer ball. Other common ball types, such as basketballs and volleyballs, can serve as the outer ball 10.

Inside the ball 10 is a relatively small and heavy mass. The mass is made of a bladder 20 with a flexible wall. A liquid 22 is provided inside the bladder. The liquid should be relatively inert so that it does not react with the wall of the bladder. Water is well suited. Anti-freeze material may be used with water if the ball is subject to use in cold weather. Or, a different liquid could be selected to obtain a desired viscosity. The liquid should be nontoxic.

A suitable material for the bladder 20 is latex. A simple balloon can be used. When filled with water, the balloon can be inflated to any desired size, so long as it is smaller than the ball 10. Gas can optionally be included inside the bladder 20 along with the liquid 22.

The device is used as a substitute for a normal ball in any game wherein a ball is rolled on a surface, kicked, or thrown. Because the bladder 20 is moveable and flexible, it travels along the inside of the wall of the ball 10 as the ball travels. As the bladder 20 moves, the liquid inside the ball undulates due to its relatively large mass and the flexibility of the wall of the bladder. This causes the device to move highly erratically.

Figure 2:
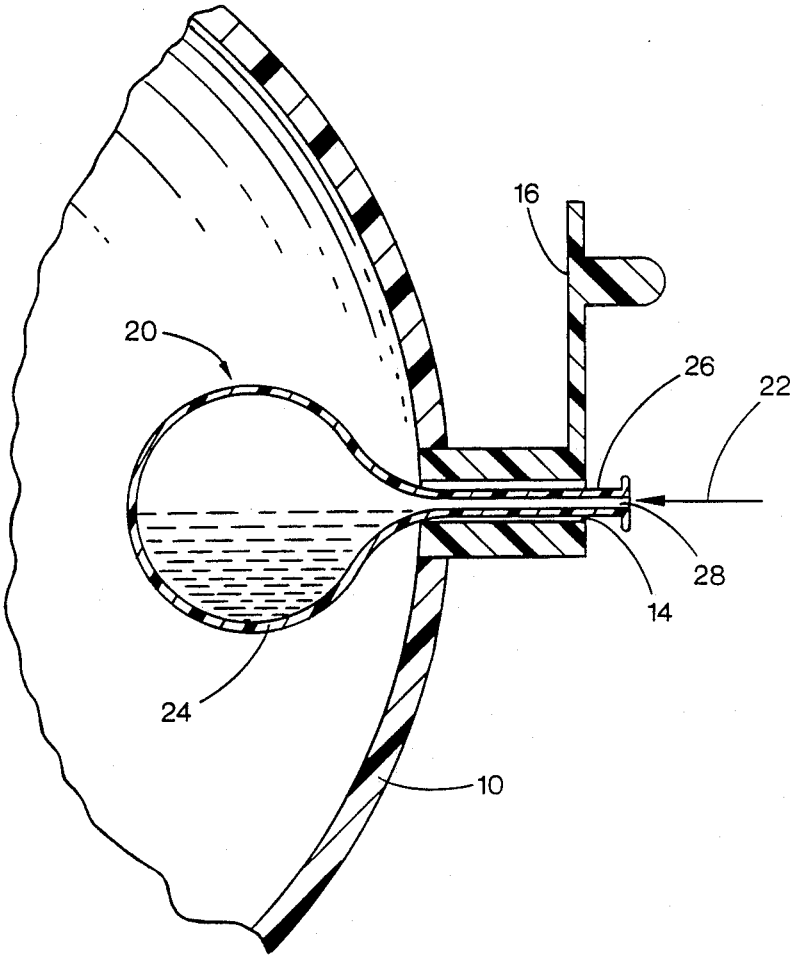
FIG. 2 is an enlarged, partial, cross-sectional view of the ball of FIG. 1, during installation of an inner bladder.

The device can be constructed by any number of conventional techniques. As shown in FIG. 2, one appropriate method is to obtain a ball 10 with a sealable inflation opening 14 then insert the body 24 of a balloon 20 through the opening so that it is located inside the ball 10. The balloon, which has a tubular protrusion or mouth portion 26, is positioned so that at least a portion of the protrusion 26 remains outside the ball 10. Water 22 can then be injected into the body 20 of the balloon via a passageway 28 that is defined by the protrusion 26. Water is injected until the body 24 is filled to a desired size, then the mouth portion 26 of the balloon tied. The tied mouth of the balloon is then pushed into the ball 10 through the filler opening 14 so that it can move freely inside the ball 10. Next the ball 10 is inflated with air to a desired pressure, and the filler cap 16 closed. Thereafter the ball is ready for use.

More simply, the bladder 20 could be prepared first, then enclosed within the outer ball 10 at the time the outer ball is manufactured.

Numerous alterations of the structure herein disclosed will suggest themselves to those skilled in the art. However, it is to be understood that the present disclosure relates to a preferred embodiment of the invention which is for the purpose of illustration only, and not to be construed as a limitation of the invention.

I claim:

1. An erratically movable game device comprising:

a hollow ball; and a relatively small mass enclosed within the ball, the mass comprising a flexible bladder containing a liquid such that when the device is rolled or projected through the air, the bladder as a whole moves around inside the ball and changes shape as it moves, the movement and changing of shape of the bladder causing the device to travel erratically.

2. The device of claim 1 wherein the ball is made of an elastomeric material and is inflated with a gas.

3. The device of claim I wherein the bladder is made of an elastomeric material and the liquid is water.

4. An erratically movable game device comprising:

a hollow ball made of an elastomeric material and inflated with air; and a relatively small and heavy mass enclosed within the ball, the mass comprising a flexible, elastomeric bladder substantially filled with liquid such that when the device is rolled or projected through the air, the bladder as a whole moves around inside the ball and changes shape as it moves, the movement and changing of shape of the bladder causing the device to travel erratically.

* * * * *

UNITED STATES PATENT AND TRADEMARK OFFICE

CERTIFICATE OF CORRECTION

PATENT NO. : 4,986,540

DATED : January 22, 1991

INVENTOR(S) : William O. Leslie

It is certified that error appears in the above-identified patent and that said Letters Patent is hereby corrected as shown below:

On the title page, item "[22] Filed: Apr. 20, 1990" should be --[22] Filed: Apr. 25, 1990--.

Signed and Sealed this

Second Day of March, 1993

*Attest:*

STEPHEN G. KUNIN

*Attesting Officer*

*Acting Commissioner of Patents and Trademarks*